US005735932A

United States Patent [19]

Stephenson et al.

[11] Patent Number: 5,735,932

[45] Date of Patent: Apr. 7, 1998

[54] PROCESS FOR THE CONVERSION OF URANIUM OXIDE TO URANIUM METAL AND URANIUM ALLOYS

[75] Inventors: Michael J. Stephenson, Oak Ridge; Waldo R. Golliher, Knoxville; Paul A. Haas, Knoxville; Lark A. Lundberg, Knoxville, all of Tenn.

[73] Assignee: M4 Environmental Management Inc., Oak Ridge, Tenn.

[21] Appl. No.: 683,895

[22] Filed: Jul. 19, 1996

[51] Int. Cl.[6] ..... C22B 60/00

[52] U.S. Cl. ..... 75/399; 75/393; 423/253; 423/5; 588/201

[58] Field of Search ..... 75/398, 399, 393; 423/5, 253; 588/201

[56] References Cited

U.S. PATENT DOCUMENTS

| | | | |
|---|---|---|---|
| 4,534,792 | 8/1985 | Elliot | 75/399 |
| 4,717,420 | 1/1988 | Duerksen | 75/399 |
| 5,147,616 | 9/1992 | Ackerman et al. | 423/5 |
| 5,160,367 | 11/1992 | Pierce et al. | 75/397 |
| 5,202,100 | 4/1993 | Nagel et al. | 423/5 |
| 5,211,742 | 5/1993 | Amamoto | 75/399 |
| 5,322,547 | 6/1994 | Nagel et al. | 75/414 |
| 5,324,341 | 6/1994 | Nagel et al. | 75/503 |

*Primary Examiner*—Ngoclan Mai

*Attorney, Agent, or Firm*—Pillsbury Madison & Sutro LLP

[57] ABSTRACT

A process for preparing uranium metal or alloy thereof suitable for use in a metal-based uranium enrichment plant or other use requiring a superdense metal comprising providing a molten metal bath containing the alloy metal and feeding uranium oxide and a reactive metal reductant into the molten metal bath so that the oxide is reduced to elemental uranium and alloying the thus formed uranium with the bath metal.

46 Claims, 2 Drawing Sheets

Inert Gas Recycle
Ar with CaO/Ca
16
3
2
7
$UO_3$,Ar
Ca,Fe,Ar
13
12
14
Ceramic Phase
(CaO with Ca)
15
UFe Alloy
(-96wt%U)
Reactor Temperature:900-1300°C
Reactor Pressure: 1-2bar
6
8
4
11
10
5
9
Induction
System
Power input

PROCESS FOR THE CONVERSION OF URANIUM OXIDE TO URANIUM METAL AND URANIUM ALLOYS

The present invention relates to the preparation of uranium metal and uranium alloys directly from uranium oxide feedstocks. The alloys are superdense and particularly suitable for use in metal-based uranium enrichment processes although other uses of these superdense metals, such as radiation shielding, ballast weights and flywheels, are also contemplated.

BACKGROUND OF THE INVENTION

It is well known to use $UF_6$ as the feedstock in various types of uranium enrichment processes, e.g., in a gaseous diffusion or gas centrifuge plant, to provide for enrichment of normal assay uranium in the U-235 isotope. A recent development is the AVLIS (Atomic Vapor Laser Isotope Separation) enrichment process which requires the use of a uranium-iron (UFe) alloy feed. However, unlike the enrichment procedures which use $UF_6$, for which there is ample supply, sources of UFe alloy feed are much more limited. Consequently UFe alloy is needed for the AVLIS process. Additionally, since uranium is one of the denser metals, the metal and its alloys have the broad potential to be used in such diverse applications as radiation shielding as well as counterweights, ballast weights and flywheels.

Procedures for preparing uranium and uranium alloys are complex and, as a consequence, the metal and its alloys are relatively expensive to produce using traditional technology thus impacting unfavorably on the economic competitiveness of the AVLIS process and other uses and applications of the metal or its alloys. For example, the conversion of uranium ore concentrate (UOC) into the metal form via the traditional thermite bomb reduction route requires multiple chemical processing steps to first prepare $UF_4$. The $UF_4$ is subsequently placed in a batch-operated bomb reactor with magnesium or calcium metal and heated to ignition. After the reactor is cooled to near ambient temperature, the resulting uranium metal ingot is manually recovered from the $MgF_2$ or $CaF_2$ slag. UFe alloy is produced in another operation by mixing the appropriate quantity of iron with the uranium and heating until molten.

The above-mentioned bomb reduction process, which is commonly referred to as the Ames process, has been used commercially for over 50 years to prepare bulk quantities of uranium metal. The Ames process is reliable and quality metal can be produced thereby. However, the resulting product is expensive. Thus, in addition to the high cost of the uranium feed ($UF_4$), the price of the uranium metal is driven by the labor-intensive nature of the batch process and the high disposal cost of the resulting uranium contaminated magnesium or calcium fluoride.

Because of the inefficiencies of the Ames process, primarily because of the practical issues related to reactivity, control, inadequate reactant distribution and product separation, recent development efforts have focused on the technical possibility of continuous metallothermic processes featuring the reduction of $UF_4$ or $UCl_4$. The Elliott process (U.S. Pat. No. 4,552,588) is based on the continuous reduction of $UF_4$ by magnesium. It is a multistep process involving reduction, separation of phases, and by-product recycle stages. The reduction reaction is carried out in a rotary furnace heated to a temperature in the range of 1000° C. The initial reduction reaction, with 4% excess magnesium, may be shown as follows:

$$UF_4(s)+2.08\ Mg\ (s)\rightarrow U(s)+2\ MgF_2(s)+0.08\ Mg(l)$$

The above reaction leads to the production of solid uranium particles dispersed in solid $MgF_2$ and excess Mg metal. The uranium metal and by-products are separated in the second stage of the process. For this operation, the mixed product is fed into a reactor containing a molten salt bath of $MgF_2$-$CaCl_2$ at a temperature above the melting point of metal, in the range of 1150° C.

Use of a continuous flow $UF_4$ conversion reactor in the Elliott process raises complex problems related to thermal balance, reactant mixing, containment and process control. It is also noted that the relatively high cost of $UF_4$ limits the overall economics of any $UF_4$-based conversion process.

Laboratory production of small quantities of uranium alloy by reduction of uranium tetrachloride ($UCl_4$) with magnesium metal has also been demonstrated with some success (U.S. Pat. No. 5,421,855). While technically feasible, the chloride-based metal process lacks the supporting feed industry to provide the required $UCl_4$ feedstock. Also, the practical use of the chloride route is made difficult by the extremely hygroscopic character of the chloride salt and resulting oxychloride contaminant.

The disposition of waste products is also another complicating factor in prior continuous procedures for preparing UFe alloys primarily because of the entrainment of significant levels of uranium in the by-product metal fluoride salt.

As will be evident from the foregoing, there is a real need for a process for preparing uranium metal and uranium alloys, for example, UFe alloys, which uses an available and relatively inexpensive uranium feed, requires less labor and processing steps, produces minimum waste and satisfies overall economic considerations. The principal object of the present invention is to provide such a process. Other objects will also be hereinafter apparent.

SUMMARY OF THE INVENTION

Broadly stated, uranium metal and uranium alloys, particularly UFe alloys, are prepared, according to the invention, by a process which comprises providing a molten metal bath in a closed reaction vessel, the molten metal bath initially comprising molten uranium, molten iron or other molten metal or uranium alloy (depending on the product desired), injecting uranium oxide ($UO_n$) and reactive metal reductant into the molten metal bath at conditions such that the reductant reduces the uranium oxide to uranium metal, the latter being alloyed with any iron or other molten metal present in the bath. It will be appreciated that uranium metal is obtained if the molten bath comprises only uranium and that an alloy is obtained if the molten metal bath comprises another metal, e.g. iron.

The uranium metal or uranium alloy thus formed and by-product reactive metal oxide are mutually immiscible with the result that these two components can be readily separated by simple physical means. This may be accomplished by withdrawing a portion of the molten mixture into a quiescent zone within or outside the reaction vessel where the alloy and by-product oxide separate by density differences into distinct phases such that the uranium or alloy can be recovered and the by-product reactive oxide metal can be further processed to provide reactive metal reductant for recycle back to the molten metal bath of the reaction vessel.

In somewhat more detail, the process, as specifically directed towards the preparation of uranium alloys from a uranium oxide feed, comprises the steps of:

(a) providing a molten metal bath, the molten metal having a Gibbs free energy of formation of oxide, under the temperature and oxygen partial pressure of the bath, greater than the Gibbs free energy of formation of the uranium oxide;

(b) feeding uranium oxide under the surface of the molten metal bath;

(c) co-feeding reactive metal reductant under the surface of the molten metal bath at a rate and with mixing which causes the uranium oxide to be reduced to the metal, the reactive metal reductant having a Gibbs free energy of formation of oxidation, under the temperature and oxygen partial pressure of the bath, less than the Gibbs free energy of formation of the uranium oxide;

(d) forming a liquid uranium metal alloy with the molten metal bath whereby the liquid uranium metal alloy is discharged from the molten metal bath for subsequent recovery; and (e) discharging the oxide of the reactive metal reductant from the molten metal reactor for subsequent recovery and recycle.

Similarly, the preparation of uranium metal itself from uranium oxide feed according to the invention may be described as comprising the following steps:

(a) providing a molten metal bath of uranium metal;

(b) feeding uranium oxide under the surface of the molten metal bath;

(c) co-feeding reactive metal reductant under the surface of the molten metal bath at a rate and with mixing which causes the uranium oxide to be reduced to the metal, the reactive metal reductant having a Gibbs free energy of formation of oxide, under the temperature and oxygen partial pressure of the bath, less than the Gibbs free energy of formation of the uranium oxide;

(d) forming a liquid uranium metal product whereby the liquid uranium metal is discharged from the molten metal bath for subsequent recovery; and (e) discharging the oxide of the reactive metal reductant from the molten metal reactor for subsequent recovery and recycle.

It will be appreciated that when the process is started, the composition of the molten metal bath will depend on whether or not uranium metal or alloy thereof is desired and, if an alloy, the nature of such alloy. Thus, the bath may comprise primarily molten uranium, molten iron or other molten metal, chosen to provide a desired uranium alloy. However, as the process proceeds with the addition of $UO_n$ and reactive metal co-feed, such as Ca or Mg, the bath becomes a mixture of molten uranium metal or molten uranium alloy and by-product reactive metal oxide. With the continuous or intermittent addition of bath metal, reductant and $UO_n$ to make up for alloy and by-product oxide removed from the system, steady-state operations can be reached so the process is operated with a constant molten bath composition to consistently give the desired uranium metal or uranium alloy composition.

A particularly useful feature of the process for the AVLIS application is that the required UFe alloy can be prepared and removed from the reactor in the molten state and fed directly into appropriate casting molds to give the alloy the shape required for use in the AVLIS process.

BRIEF DESCRIPTION OF THE DRAWINGS

Other features of the invention will be evident from the following description of preferred embodiments and the accompanying drawings wherein.

DESCRIPTION OF THE PREFERRED EMBODIMENTS

Figure 1:
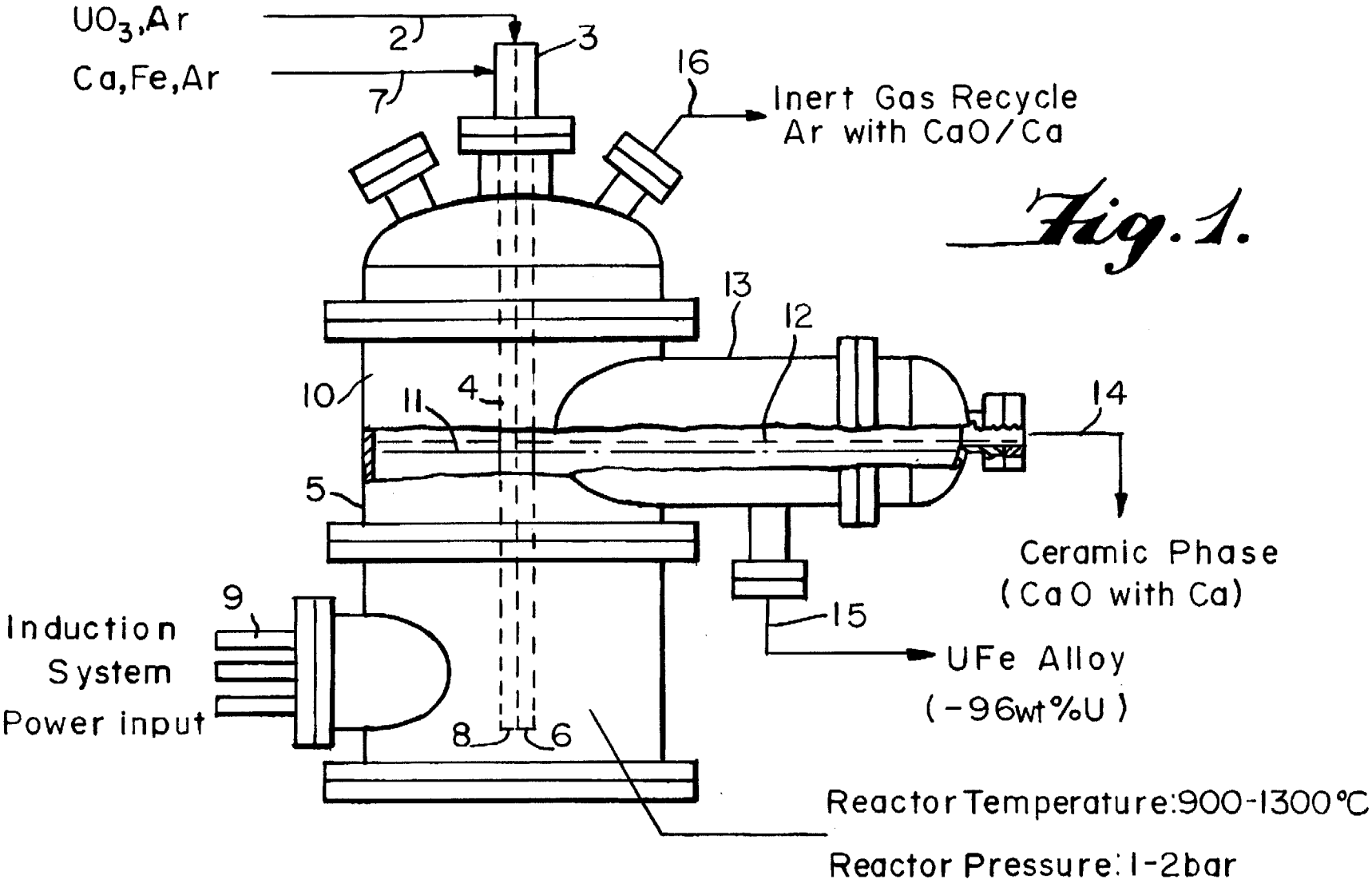
FIG. 1 is a schematic drawing illustrating the process of the invention.

The uranium metal and uranium alloys of the invention are preferably prepared using various types of commercially available molten metal reactors with chemically compatible refractory liners. The process involves the introduction of uranium oxide feed materials and certain reactive and alloying metals directly into the molten metal bath containing, for example, iron or nickel. The operating temperature of the molten metal reactor is limited by the melting and boiling temperatures of the chosen metal or alloy and is selected to maximize the thermodynamics and kinetics of the desired chemical conversion reaction (e.g. 1000° to 1600° C.). Additionally, the melt provides a heat source or sink with heat transfer characteristics, which minimizes temperature fluctuations and ensures optimum performance.

The preferred $UO_n$ for use herein is $UO_3$ although other oxide forms, e.g., $UO_2$, $U_3O_8$ or even uranium ore concentrate (UOC), may also be used provided the conditions used are such that the thermodynamics are favorable, chemical kinetics sufficiently fast and the resulting uranium metal is suitable for alloying.

Only calcium and magnesium have sufficiently favorable Gibbs free energy of formation of oxidation for use as the reactive metal reductant. Other metals appear to lack the thermodynamic potential to reduce uranium oxides. The free energy of formation of CaO is significantly lower than the free energy formation of MgO. Hence, CaO is preferred for present purposes.

It is also noted that the volatility of magnesium, unlike that of calcium, is such that a pressurized reactor may be required. This is a further reason why magnesium is less preferred for use herein than calcium for present purposes although magnesium can be used, if desired.

Using calcium metal as the reductant and $UO_3$ as the uranium oxide starting material, the reaction proceeds as follows to provide elemental uranium for the desired alloy formation in the molten bath:

$$UO_3+3Ca \rightarrow U+3CaO$$

The U metal product then forms a low melting alloy with the molten bath metal. The composition of the alloy for AVLIS application can be varied depending on, for example, the relative amount of uranium oxide and iron fed to the bath. Generally, the alloy may comprise from about 50–98 weight percent uranium, preferably about 96–97 weight percent uranium, with the balance essentially iron. A preferred alloy composition is one having the composition $U_6Fe$ (about 96 weight percent uranium, 4 weight percent iron) with a melting point of about 900° C. This composition is preferred because it can be cast directly into iron sleeves and meets the overall U/Fe ratio required for AVLIS feed.

It is noted that the process by-product CaO and any excess Ca are not soluble in the molten uranium or alloys which are obtained. As a consequence, the CaO and Ca can be readily separated from the uranium metal or alloy product. CaO and excess Ca will not normally be liquid at the operating conditions of the reactor. In the preferred embodiment of this invention, a major fraction of this material is entrained as a finely divided solid in the inert gas stream flowing from the molten metal bath and is collected external to the reactor by off-gas filtration. Alternatively, the reactive metal oxide can be removed directly from the surface of the molten metal bath with a suitable vacuum/filter device known to the industry. Optionally, the reactive metal oxide can be mixed with other metal oxides, chlorides or fluorides to form low melting eutectics that can be tapped from the reactor in a manner common to the molten metals industry.

For present purposes, the reactor is advantageously operated at a temperature in the range of 900°–1600° C. and a pressure of 1–5 bar, preferably 1–2 bar. The temperature used should be at least above the melting point of the uranium alloy and preferably above the melting point of uranium metal (1132° C.).

Advantageously the $UO_3$ or like oxide is fed to the reactor in particulate form suspended in an inert gas, e.g., argon. The gas provides a modest overpressure (e.g. about 5 to 20 psi above the operating pressure of the reactor) to permit injection of the oxide below the surface of the molten metal bath.

The reductant and iron or other alloying metal may be fed to the reactor separately or mixed together in particulate form. This feed is also preferably accomplished with argon or other inert gas at overpressure to facilitate addition to the molten metal bath in the same vicinity as the oxide feed and with sufficient energy to ensure intimate mixing of the reductant and alloying components. Optionally the reductant and alloying metal may be premixed with the uranium oxide.

The reactor is heated by any induction or resistance furnace system to keep the contents at the desired temperature. Induction heating is preferred as this, together with the injection of the oxide, metal and reductant by lance or tuyere below the surface of the molten metal, provides for the most effective circulation and intermixing of bath components.

According to one way of practicing the invention, UFe alloys are prepared by first feeding iron or, optionally, a mixture of iron and uranium metal into the reactor, and heating this mixture to a temperature of 900°–1600° C., depending on the melting point of the metal mix and desired reaction temperature to form a melt of iron or iron-uranium.

Thereafter the uranium oxide, preferably $UO_3$, is fed into the melt along with sufficient reductant so as to bring about the formation of uranium metal and its alloying with the iron in the bath.

As an alternative to the foregoing, an initial amount of the $UO_3$, reductant and iron, all in particulate form, can be fed, pre-mixed or separately, into the reactor where the mixture is heated to form a molten bath to which, after equilibrium conditions are reached, the required components are then fed with continuous or semi-continuous removal of alloy and by-product.

The relative amounts of uranium oxide, alloying metal and reductant fed to the reactor are chosen to provide the desired alloy composition. The specific amounts of these components which are used in any particular situation, will depend on other factors, primarily the chemical composition of the oxide, the reductant and the desired alloy composition. Optimum amounts can be readily determined for any particular reaction conditions, e.g., temperature and alloy composition. Usually, however, when $UO_3$ and calcium are used as the oxide and reductant respectively, these will be used in near stoichiometric amounts, and preferably with the reductant in slight excess, typically around 5 to 10% of the stoichiometric amount to ensure essentially complete conversion of the uranium oxide to metal. Thus, for example, from 44.1 to 46.2 parts by weight of calcium reductant will normally be used per 100 parts of $UO_3$. The calcium reductant will be converted into 58.8 parts by weight CaO per 100 parts of $UO_3$. Excess Ca, totalling 2.11 to 4.22 parts by weight per 100 parts of $UO_3$ will accumulate with the CaO. In the case of an iron alloy, once the steady state alloy composition is achieved in the molten metal reactor, iron will be added in an amount of 3.25 parts per 100 parts of $UO_3$ to maintain the $U_6Fe$ composition.

Once all of the required components are present in the molten bath, reduction and alloying occur relatively quickly, e.g., typically in less than 1 second. When the desired alloy composition is reached, steady state conditions can be maintained by adding uranium oxide, iron and reductant to make up for the amounts removed. As a consequence, the process can be carried out continuously although batch or semi-batch operations are also contemplated.

Advantageously the reactor is equipped with a draw-off arm or equivalent area which provides a quiescent zone where a portion of the bath, near the surface thereof, can be drawn off to permit the alloy which is formed and reductant by-product oxide and excess reductant to separate out from each other by density differences. The alloy can then be recovered and the by-product suitably withdrawn and subsequently processed for recycle of the reductant.

Referring now more specifically to the drawings, FIG. 1 shows a schematic of a molten metal reactor with $UO_3$ being fed, as a particulate suspension in argon gas (Ar) via line (2) into the inlet (3) of a two channel or diannular lance (4) which extends into reactor (5) for discharge of the $UO_3$ at (6) under the surface of the molten metal.

Calcium metal reductant (Ca) and iron (Fe) in particulate form and suspended in argon (Ar) are also fed as shown at (7) to the lance (4) for discharge at (8) near the discharge point of $UO_3$ at (6). The reactor is heated by induction means (9) so that a molten metal bath (10) at 900°–1600° C. is formed and maintained within the reactor. The pressure is desirably maintained near atmospheric at 1–2 bar.

Due to the relatively small particle size of the resulting CaO (i.e. in the 1 to 10 micron range), at least part of the CaO and unreacted Ca is entrained in the reactor off-gas and is discharged at (16).

The reactor is provided with the horizontal arm (13) positioned approximately at the surface (11) of the molten metal bath and surface (12) of the layer of CaO and unreacted Ca. The arm (13) is a hollow cylinder with suitable refractory lining which provides a quiescent zone where the balance of the CaO and excess Ca is permitted to accumulate as a separate ceramic phase on top of molten alloy, CaO with excess Ca being removed at (14) while the UFe alloy (preferably as a eutectic of about 96 weight % U, balance Fe) is recovered at (15).

The $UO_3$, Ca, Fe feeds are continued as needed to maintain the molten metal bath at about a constant level as shown at (11), taking into account material withdrawn from the reactor at (14), (15) and (16).

It will be appreciated that after the molten bath is formed, the lance permits the reactant to be injected under the surface of the bath metal under argon overpressure. This overpressure should be sufficient to force the feed materials out of the lance into the molten metal bath with sufficient energy for the required mixing and contacting of components for reduction of uranium oxide and alloying of the resulting metal. As an alternative to the lance feed, a tuyere-based feed system positioned on the bottom or side of the reactor can be used if a higher level of reactant mixing is desired to allow a more rapid approach to thermodynamic equilibrium.

Figure 2:
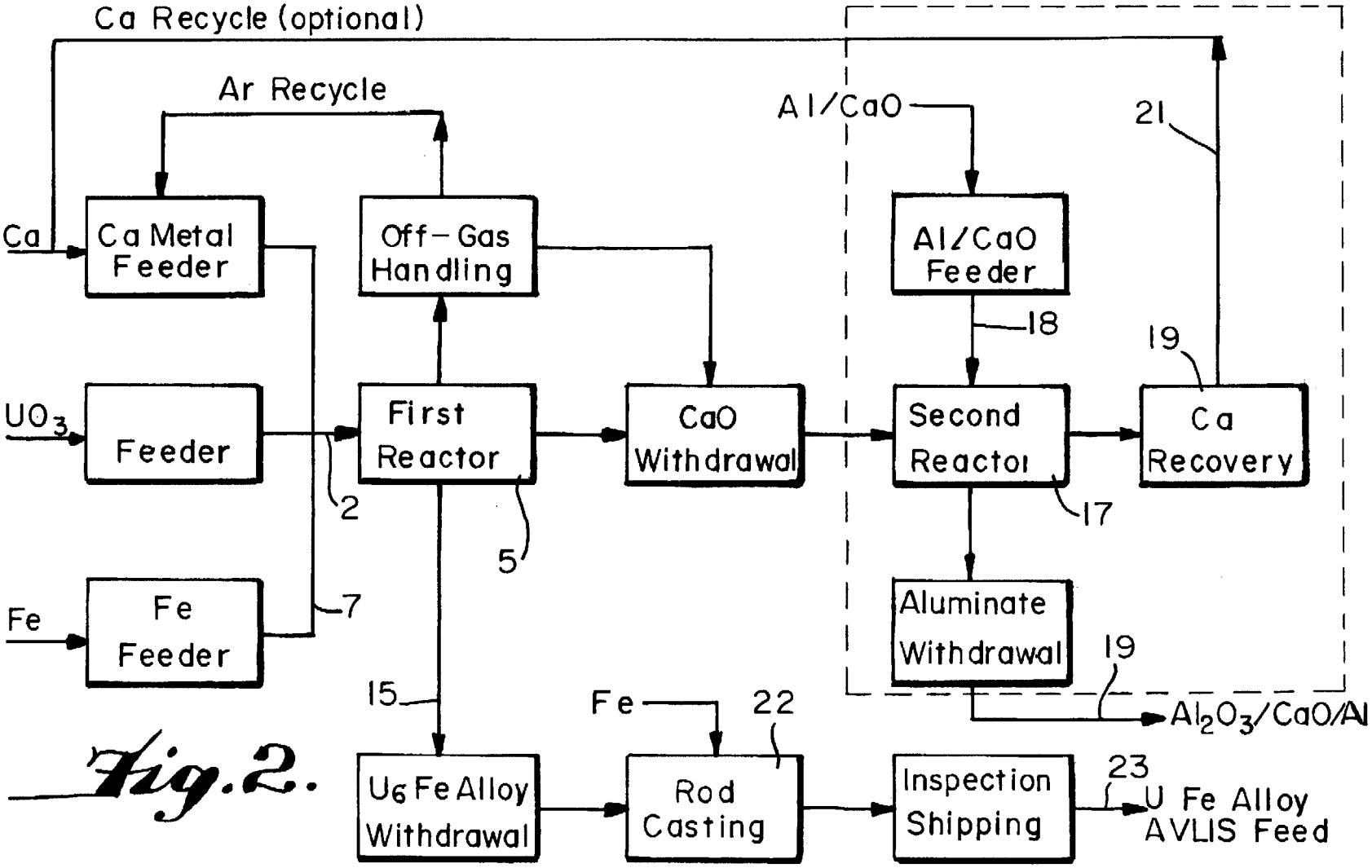
FIG. 2 is a diagram showing an overall system according to the invention including recycle of reaction components.

FIG. 2 shows an overall system for making UFe alloys according to the invention with conversion of CaO by-product to Ca for recycle to the alloy-forming reactor. In the system shown, by-product (CaO) from the reactor (5) is fed to a second molten metal reactor (17) which is operated using molten aluminum at a temperature of 1200°–1400° C. and a reduced pressure (e.g., 0.1 mm Hg). A mixture of Al and makeup CaO is also separately provided, as shown at (18), to the second reactor (17). This results in the formation of calcium metal and an aluminate composition comprising $Al_2O_3$/CaO/Al as shown at (19) and (20), respectively. The aluminate composition can be discharged from system while the calcium metal is recycled as shown by line (21) for use as Ca feed to the first molten metal reactor (5) for reduction of $UO_3$ to give the uranium metal needed to form the desired UFe alloy.

The aluminum used in reactor (17) can be scrap aluminum to provide savings over the use of finely divided aluminum powder required for the traditional aluminothermic process although if desired such powder or other equivalent can be used as the aluminum source. The resulting aluminate has potential value in the uranium industry as a chemical trapping agent for $UF_6$, HF and $F_2$.

The casting step of FIG. 2 is integrated with the alloy preparation as shown at (22). The casting is carried out while the alloy from the molten metal reactor (5) is still molten. As earlier noted, this represents a particularly useful aspect of the invention. According to this feature, the alloy while molten is channeled directly into Fe sleeves as shown at (22) to produce, for example, the alloy feed rods required for the AVLIS system represented generally by the numeral (23). By arranging the mold assembly in this way, it is possible to eliminate the need for metal reheating in order to form the feed material required for the AVLIS application.

The invention is further illustrated by the following examples:

EXAMPLE 1

The reactor (5) is charged with 960 lbs. of U metal and 40 lbs. of Fe and heated to 1150° C. at essentially ambient pressure. The melting point of the 96% U alloy is around 830° C. With the reactor at the target temperature, 100 lbs/hr of dry, free-flowing, commercial grade $UO_3$ and 2 scfm of Ar are fed through the center tube (2) of a two flow channel concentric tube lance (3) inserted 12 inches below the surface of the molten metal (11). Concurrently, 44.1 lbs/hr of Ca metal (5% stoichiometric excess) premixed with 3.45 lbs/hr of Fe are fed to the annulus (7) of feed lance (3), along with 3 scfm of Ar. The lance is operated under an overpressure of around 10 psi relative to the reactor pressure to ensure intimate mixing of feed components and distribution of reaction products under the surface of the molten metal bath. UFe alloy (96 wt % U) is withdrawn at a rate of 86.7 lbs/hr from the reactor from the sidearm (13) at the metal product withdrawal point (15) to maintain a constant reactor metal inventory. Approximately 60% or 35.3 lbs/hr of the resulting CaO and 1.27 lbs/hr of unreacted Ca metal are entrained in the inert gas (5 scfm) leaving the reactor at (16). The balance of the CaO (23.5 lbs/hr) and Ca metal (0.84 lb/hr) is withdrawn from the reactor sidearm at (14). Feed of materials and removal of reaction products and excess reductant are carried out on a continuous flow basis. The molten alloy is subsequently cast into steel sleeves of desired dimensions using a system according to FIG. 2.

EXAMPLE 2

The reactor (5) is charged with 960 lbs. of U metal and 40 lbs. of Fe and heated to 1150° C. at essentially ambient pressure. In this case, 100 lbs/hr of $UO_2$ and 2 scfm of Ar are fed through the center tube (2) of a two flow channel concentric tube lance (3) inserted 12 inches below the surface of the molten metal (11). Concurrently, 31.2 lbs/hr of Ca metal premixed with 3.67 lbs/hr of Fe are fed to the annulus (7) of feed lance (3), along with 3 scfm of Ar. The lance is operated under an overpressure of around 10 psi relative to the reactor pressure to ensure intimate mixing of feed components and distribution of reaction products under the surface of the moltenmetal bath. UFe alloy is withdrawn at a rate of 91.8 lbs/hr from the reactor from the sidearm (13) at the metal product withdrawal point (15) to maintain a constant reactor metal inventory. Approximately 60% or 24.9 lbs/hr of the resulting CaO and 0.89 lbs/hr of unreacted Ca metal are entrained in the inert gas (5 scfm) leaving the reactor at (16). The balance of the CaO (16.6 lbs/hr) and Ca metal (0.59 lb/hr) is withdrawn from the reactor sidearm at (14).

EXAMPLE 3

The reactor (5) is charged with 1000 lbs. of U metal and heated to 1200° C. at essentially ambient pressure. The melting point of U metal is 1132° C. In this case, 100 lbs/hr of $UO_3$ and 2 scfm of Ar are fed through the center tube (2) of a two flow channel concentric tube lance (3) inserted 12 inches below the surface of the molten metal (11). Concurrently, 44.1 lbs/hr of Ca metal is fed to the annulus (7) of feed lance (3), along with 3 scfm of Ar. The lance is operated under an overpressure of around 10 psi relative to the reactor pressure to ensure intimate mixing of feed components and distribution of reaction products under the surface of the molten metal bath. U metal is withdrawn at a rate of 83.2 lbs/hr from the reactor from the sidearm (13) at the metal product withdrawal point (15) to maintain a constant reactor metal inventory. Approximately 70% or 41.2 lbs/hr of the resulting CaO and 1.48 lbs/hr of unreacted Ca metal are entrained in the inert gas (5 scfm) leaving the reactor at (16). The balance of the CaO (17.6 lbs/hr) and Ca metal (0.63 lb/hr) is withdrawn from the reactor sidearm at (14).

It will be recognized that the direct reduction of uranium oxide to uranium metal and alloy, according to the invention, avoids the high costs associated with the conversion of uranium oxide to a halide. Furthermore, simultaneously alloying the uranium with iron or other metal, such as nickel, enhances the economic benefits of the present process. The invention also avoids generating, as a by-product, uranium contaminated metal fluoride residue which would require low level radioactive waste disposal in a commercial facility. In contrast, the present process produces calcium oxide as a by-product and can be converted to Ca metal for recycle as shown. Alternatively, the CaO can be used as a chemical additive, for example, to adjust pH in a waste water treatment plant.

Various modifications may be made in the invention and its practice described in the foregoing. Accordingly, the invention is defined in the following claims wherein:

We claim:

1. A process for preparing a uranium metal alloy from a uranium oxide feed, said process comprising the steps of:

(a) providing a molten metal bath, said molten metal having a Gibbs free energy of formation of oxide, under the temperature and oxygen partial pressure of the bath, greater than the Gibbs free energy of formation of said uranium oxide;

(b) feeding uranium oxide under the surface of said molten metal bath;

(c) co-feeding reactive metal reductant under the surface of said molten metal bath at a rate and with mixing which causes said uranium oxide to be reduced to the metal, said reactive metal reductant having a Gibbs free energy of formation of oxidation, under the temperature and oxygen partial pressure of the bath, less than the Gibbs free energy of formation of said uranium oxide;

(d) forming a liquid uranium metal alloy with said molten metal bath whereby said liquid uranium metal alloy is discharged from the molten metal bath for subsequent recovery; and (e) discharging the oxide of said reactive metal reductant from the molten metal reactor for subsequent recovery and recycle.

2. A process of claim 1 wherein said bath metal includes iron.

3. A process of claim 1 wherein said bath metal includes nickel.

4. A process of claim 1 wherein said bath metal includes a uranium alloy.

5. A process of claim 1 wherein said uranium oxide and said reactive metal reductant are pre-mixed outside the said molten metal reactor.

6. A process of claim 1 wherein said uranium oxide comprises $UO_3$.

7. A process of claim 1 wherein said uranium oxide comprises $UO_2$.

8. A process of claim 1 wherein said reactive metal reductant comprises elemental calcium.

9. A process of claim 8 wherein the resulting calcium oxide by-product is fed to a second molten metal bath containing aluminum and converted to calcium metal by aluminothermic reaction for recycle.

10. A process of claim 1 wherein said reactive metal reductant comprises elemental magnesium.

11. A process of claim 1 wherein said molten bath operates at a temperature at least greater than the melting point of said bath metal.

12. A process of claim 11 wherein the temperature of the bath is in the range of 900° C. to 1600° C.

13. A process of claim 1 wherein said molten metal reactor operates near atmospheric pressure.

14. A process of claim 1 wherein said reactive metal reductant is fed to said molten metal bath in about a 1:1 stoichiometric ratio with respect to said uranium oxide feed rate.

15. A process of claim 1 wherein the reduction reaction is carried out semi-continuously.

16. A process of claim 1 wherein the reduction reaction is carried out continuously.

17. A process of claim 1 wherein said uranium oxide and said reactive metal reductant are fed from the top of said molten metal reactor with a lance feed system.

18. A process of claim 17 wherein inert gas is fed with said uranium oxide feed and said reactive metal reductant.

19. A process of claim 1 wherein said uranium oxide and said reactive metal reductant are fed from the bottom or side of said molten metal reactor with a tuyere feed system.

20. A process of claim 19 wherein inert gas is fed with said uranium oxide feed and said reactive metal reductant.

21. A process of claim 1 wherein said molten metal bath containing said uranium alloy and said reductant oxide is moved to a quiescent zone to allow the alloy to separate from the oxide.

22. A process of claim 1 wherein said reductant oxide is entrained in an inert gas and at least partially collected outside the molten metal reactor by filtration of said inert gas.

23. A process of claim 1 wherein said reductant oxide is at least partially collected from the surface of the molten metal by mechanical means.

24. A process of claim 23 wherein at least one vitreous phase former is added to the reactor to allow removal of said reductant oxide as a liquid phase by mechanical means.

25. The process of claim 24 wherein the vitreous phase former includes $CaCl_2$.

26. A process for preparing uranium metal from a uranium oxide feed, said process comprising the steps of:

(a) providing a molten metal bath of uranium metal;

(b) feeding uranium oxide under the surface of said molten metal bath;

(c) co-feeding reactive metal reductant under the surface of said molten metal bath at a rate and with mixing which causes said uranium oxide to be reduced to the metal, said reactive metal reductant having a Gibbs free energy of formation of oxide, under the temperature and oxygen partial pressure of the bath, less than the Gibbs free energy of formation of said uranium oxide;

(d) forming a liquid uranium metal product whereby said liquid uranium metal is discharged from said molten metal bath for subsequent recovery; and (e) discharging the oxide of said reactive metal reductant from the molten metal reactor for subsequent recovery and recycle.

27. A process of claim 26 wherein said uranium oxide includes $UO_3$.

28. A process of claim 26 wherein said uranium oxide includes $UO_2$.

29. A process of claim 26 wherein said uranium oxide and said reactive metal reductant are pre-mixed outside the molten metal reactor.

30. A process of claim 26 wherein said reactive metal reductant includes elemental calcium.

31. A process of claim 30 wherein the resulting calcium oxide by-product is fed to a second molten metal bath containing aluminum and converted to calcium metal by aluminothermic reaction for recycle.

32. A process of claim 26 wherein said reactive metal reductant includes elemental magnesium.

33. A process of claim 26 wherein said molten bath operates near atmospheric pressure.

34. A process of claim 26 wherein said reactive metal reductant is fed to said molten metal bath in about a 1:1 stoichiometric ratio with respect to said uranium oxide feed rate.

35. A process of claim 26 wherein the reduction reaction is carried out semi-continuously.

36. A process of claim 26 wherein the reduction reaction is carried out continuously.

37. A process of claim 26 wherein said uranium oxide and said reactive metal reductant are fed from the top of said molten metal reactor with a lance feed system.

38. A process of claim 37 wherein an inert gas is included with said uranium oxide feed and said reactive metal reductant.

39. A process of claim 26 wherein said uranium oxide and said reactive metal reductant are fed from the bottom of said molten metal reactor with a tuyere feed system.

40. A process of claim 39 wherein an inert gas is included with said uranium oxide feed and said reactive metal reductant.

41. A process of claim 26 wherein said molten metal bath containing said uranium and said reductant oxide is moved to a quiescent zone to allow the alloy to separate from the oxide.

42. A process of claim 26 wherein said reductant oxide is entrained in an inert gas and at least partially collected outside the molten metal reactor by filtration of said inert gas.

43. A process of claim 26 wherein said reductant oxide is at least partially collected from the surface of the molten metal by mechanical means.

44. A process of claim 26 wherein at least one vitreous phase former is added to the reactor to allow removal of the reductant oxide as a liquid phase by mechanical means.

45. The process of claim 44 wherein the vitreous phase former includes $CaCl_2$.

46. The process of claim 1 or claim 26 wherein said uranium oxide includes uranium ore concentrate.

* * * * *